US006736271B1

(12) United States Patent
Hall

(10) Patent No.: US 6,736,271 B1
(45) Date of Patent: May 18, 2004

(54) SCREEN APPARATUS AND METHOD

(76) Inventor: Peter C. Hall, 1718 Lake Grasslands W., Gallatin, TN (US) 37066

( * ) Notice: Subject to any disclaimer, the term of this patent is extended or adjusted under 35 U.S.C. 154(b) by 0 days.

(21) Appl. No.: 10/174,186

(22) Filed: Jun. 18, 2002

Related U.S. Application Data

(60) Provisional application No. 60/340,379, filed on Dec. 17, 2001.

(51) Int. Cl.[7] ..... B07C 1/49

(52) U.S. Cl. ..... 209/409; 209/408; 209/397; 209/404; 209/400; 209/315

(58) Field of Search ..... 209/400, 404, 209/405, 409, 397, 399, 309, 315, 319

(56) References Cited

U.S. PATENT DOCUMENTS

| | | | | | |
|---|---|---|---|---|---|
| 3,483,976 | A | * | 12/1969 | Williams | 209/395 |
| 3,833,120 | A | * | 9/1974 | Ogata | 209/399 |
| 3,970,550 | A | * | 7/1976 | Fry et al. | 209/399 |
| 4,219,412 | A | | 8/1980 | Hassall | 209/399 |
| 4,347,129 | A | | 8/1982 | Rutherford | 209/399 |
| 4,670,136 | A | | 6/1987 | Schmidt et al. | 209/403 |
| 4,757,664 | A | | 7/1988 | Freissle | 52/509 |
| 4,819,809 | A | | 4/1989 | Derrick | 209/275 |
| 4,857,176 | A | | 8/1989 | Derrick et al. | 209/392 |
| 5,104,521 | A | * | 4/1992 | Rutherford | 209/399 |
| 5,248,043 | A | * | 9/1993 | Dorn | 209/399 |
| 6,006,923 | A | * | 12/1999 | Helmy et al. | 209/397 |

OTHER PUBLICATIONS

Exhibit A, selected materials from website of Durex: found at http://www.teamdurex.com.
Exhibit B, selected materials from website of W.S. Tyler: found at http://www.wstyler.com.
Exhibit C, selected materials from website of Western Wire Works: found at http://www.thewesterngroup.com/index.html.
Exhibit D, selected materials from website of Linatex Corporation of America: found at http://www.linatex.com/prod–screens.html.
Exhibit E, selected materials from website of Trellex: found at http://www.metsominerals.com.
Exhibit F, selected materials from website of Derrick Corporation: found at http://www.derrickcorp.com.
Exhibit G, Brochure of Metso Minerals, "Trellex Polymer Screening Media", Derrick Corporation.

* cited by examiner

*Primary Examiner*—Donald P. Walsh
*Assistant Examiner*—Jonathan R Miller
(74) *Attorney, Agent, or Firm*—Waddey & Patterson; Lucian Wayne Beavers

(57) ABSTRACT

A panel for screening material, comprising: a frame defining a screening area; a tensioned fiber reinforcement attached to the frame and spanning across the screening area; and a non-tensioned resilient coating surrounding the fiber reinforcement so as to form a plurality of openings to screen the material. A method of making a screen for screening material and a vibratory screening machine apparatus incorporating such a screen panel are also disclosed.

36 Claims, 5 Drawing Sheets

SCREEN APPARATUS AND METHOD

This application claims benefit of Provisional U.S. Patent Application Serial No. 60/340,379, filed Dec. 14, 2001 under 37 C.F.R. § 1.53(c), entitled "Screen Panels With Internally Tensioned Fiber Reinforcement."

Be it known that I, Peter C. Hall, a citizen of the United States, residing at 1718 Lake Grasslands W, Gallatin, Tenn. 37066; have invented a new and useful "Screen Apparatus and Method."

A portion of the disclosure of this patent document contains material that may be subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

BACKGROUND OF THE INVENTION

Machines have been used to screen material for many years. The word "material" is necessarily general, because screening apparatus are used in applications from wastewater treatment and food manufacturing to the processing of aggregates and metals. Regardless of the type of material to be screened, though, separation of material based upon relative size is a valuable undertaking.

Since the predominant consideration in screening material relates to the sizes of particles to be separated, machines have been devised to screen material on an increasing scale and with greater efficiency. In the most generic sense, a screening machine consists of a hopper for receiving material and a screen at or near the lower portion of the hopper. The screen normally will have a number of openings therein for allowing material particles up to a certain size to pass through the screen. Particles that are too large to pass through any screen opening are moved out of the hopper using a method such as gravitational direction of the larger particles toward an open end of the hopper.

In order to screen with greatest efficiency, most screening machines are designed to oscillate rapidly to encourage a phenomenon called "stratification." When a container of various-sized materials is shaken, the smaller particles tend to move toward the bottom of the container, while the larger ones remain toward the top of the container. If a hole of a size roughly equivalent to the size of the smaller particles is made in the bottom of the container, the smaller particles will likely pass through the hole during shaking, having become "stratified" on the bottom of the container. In this manner, stratification increases the efficiency of the separation process.

Modern screening machines are typically rectangular boxes, usually sloped, with one or more levels of screen surface with which the material interacts. Each level of screen surface is supported by a frame to which the screen surface is fastened, bolted, or otherwise secured in order to support the screen surface against the load of material that is placed into the rectangular box and shaken. Although the screening machine may be horizontally-oriented, many screening machines are inclined at an angle between 15 and 30 degrees, with the material being fed into the upper end of the machine and being allowed to flow to the bottom end of the rectangular box, which is usually open-ended. In this manner, material which fails to pass through the screen may be collected and possibly re-screened.

In a screen machine such as the above, rapidly vibrating the screening machine as material is being processed in the machine actually causes the material to assume a fluid-like characteristic as it moves across the screen surface, which enhances the stratification properties of the machine. A common range of rates for vibrating the screen machine is 600 to 3600 RPM. The vibration of the machine is achieved by various methods, the most common of which involves having one or more weighted shafts connected or integral to the machine that, when rotated, throws the material in the machine away from the screen surface, allowing the smaller particles to come in contact with the screen surface and sift through.

Originally, screen media was made of woven wire cloth or perforated steel plate. Such media wears out rapidly when handling abrasive particles, so more wear-resistant materials such as rubber or polyurethane have been used to significantly reduce the frequency and cost of maintenance on screens. Panels made of these materials, though, will stretch until they break, so cable or fabric reinforcement has been molded into such screens to strengthen them. The reinforcement is tensioned between the side walls of the screen machine, thereby providing beneficial additional structural strength to the wear materials. Examples of such designs are seen in U.S. Pat. Nos. 4,819,809 and 4,857,176. Significantly, however, both of those patents do not innovate to the extent of the subject matter herein.

U.S. Pat. No. 4,819,809 teaches a vibratory screen having a flexible molded polyurethane body having screen openings therein, and many aramid fibers reinforcing the panel, with the entire screen being able to be tensioned in place on a vibratory screening machine. The patented screen is coated with polyurethane before tensioning of the screen, whereas the screen panel of the invention is tensioned before the panel is coated with resilient coating, resulting in greater versatility for the screen panel of the invention. Moreover, the screen panel of the instant invention involves a selection of materials that is broader than that contemplated by the patent.

U.S. Pat. No. 4,857,176 teaches a substantially similar vibratory screen to that of U.S. Pat. No. 4,819,809. However, the vibratory screen of U.S. Pat. No. 4,857,176 teaches a vibratory screen for use with an arched-bed screening machine, and as noted elsewhere herein, the screen panel of the invention is made to be installed on a flat-bed screening machine, a more efficient type of screening machine due to the fact that material being screened does not tend to work its way down the slope to the sides of the machine. Arched-bed screening machines of this type thus fail to maximize the screening area, because the material being screened moves away from the top of the arch, minimizing use of that part of the screen, and gravitates toward the lower portions of the screen, where a greater percentage of the load ensures that some material that would otherwise be screened is blocked by other material and fails to find a passage through the screen.

The screen surface of a typical screening machine is made of one or more removable screen panels attached to the frame in any of a number of ways. The screen surface may be arched in the center, being supported by an arched support frame. In this configuration, screen panels are stretched from wall to wall across the screen so that as the edges of a panel are drawn outward, the center of the panel is pulled down against the crest of the arch. The tighter the screen surface is drawn against the supporting frame, the more the panel or panels are kept from flogging, prolonging the life of the screen.

In known screening machines, the arch in the screen support frame is desirable to properly tension the panels, but the arch has an unfortunate effect of causing material riding on the screen surface to move toward the side walls of the machine, leaving the crest of the arch without material on it, thereby effectively reducing usable screen area. To address this and other deficiencies, several manufacturers introduced screen media systems incorporating a flat support frame (i.e., a "flat-bed" machine) with a number of smaller screen media modules mechanically fastened to it. These systems provide for easier maintenance and panel change-outs compared with tensioned systems, and they allow screen operators to fine-tune the separation they are achieving. For example, different panels on the same flat-bed machine can have various-sized openings, screening at different granularities on the same screening machine.

An important shortcoming of modular screen panels in known flat bed systems is that the panels are not tensioned. Instead, each screen module has rigid internal structural elements that assist in keeping the module anchored to the support frame, and also aid the screen bed to resist sagging or breaking under the load of material being screened. However, structural elements within the screen modules can significantly reduce the area that can be perforated, thereby reducing the efficiency of the screening machine. Furthermore, in portions of the module that lack structural elements, the load must be supported solely by the rubber or urethane. The result is an overly thick perforated section, with large bar widths between openings, and a correspondingly low number of openings in the panels.

The design deficiencies of flat-bed modular screen panels are magnified when trying to screen fine materials. The thickness of the screen reduces its resiliency, thereby inhibiting stratification of the material load being carried as fine particles have greater difficulty in settling through the bed. Reduced resiliency also allows material, especially damp material, to stick to the screen surface, blocking the openings in the screen. Even if such materials find an opening, small opening size (perhaps as small as 0.25 millimeters in diameter) and great thickness of the panel form a tunnel through which the materials must travel. This structural arrangement slows material separation, possibly blocking other material particles trying to move through the opening, or potentially causing particles to obstruct and permanently plug the hole. Clogging of tunnels is further exacerbated where the materials being screened are damp or where particles have a tendency to adhere to one another. For purposes of this application, "damp" materials will have approximate water content of 5 to 35 percent.

Because of these problems, modular screen panels for flat-bed screening machines have not been accepted for fine screening applications or in applications where high open areas are required for adequate screen capacity. Most screen operators would prefer the wear life, maintenance ease, and flexibility advantages afforded by modular screening systems in achieving a desired separation. However, an inability to achieve sufficient open area and a thin enough membrane force them to use wire cloth, and suffer the short wear life and high operating costs resulting therefrom.

What is needed, then, is a modular screen panel that enables the screening of materials on a flat bed or other screening machines, where such screen panels have tensioned fiber-reinforced screens. It is further needed to provide a screen panel having an increased use life, regardless of the type or granularity of materials to be screened.

SUMMARY OF THE INVENTION

The present invention generally relates to a screen panel configuration for use in modular material screening systems. More specifically, the present invention relates to a modular screen panel for use in flat-bed screening systems to dramatically increase the number of openings (and granularity of screening enabled thereby) that can be formed in the screen panel.

The screen panel of the invention incorporates a tensioned fiber support system, encased in a non-tensioned outer wearing cover made of polyurethane or rubber. In practice, the fiber tension which supports the material load on the screen is entirely internal to each modular panel. Each panel is fastened mechanically into an existing flat-bed modular screen support frame.

The internal tensioning frame consists of a load-bearing frame member along two opposite sides of the panel. A piece of threaded rod perpendicularly abuts each end of each load-bearing member, and the two opposed rods on each side are connected by and substantially enclosed in a tensioning collar resembling a very long nut. The threaded rod and collar thus act as a turnbuckle or jacking mechanism along each of the two opposite sides of the frame.

While the frame is in an untensioned state, fiber reinforcement is attached to the load-bearing members with pre-determined gaps between each strand of the fiber. The collars are then turned to cause the load-bearing members to move apart, thereby applying tension to the fiber. Tightening each side to a predetermined torque ensures uniform tensioning across the panel.

It is also possible to make a simpler tensioning mechanism by welding spring steel between the load-bearing members and introducing a compressive force on the spring steel to impart a slight bow to the panel. At that point, the fiber would be wound onto the panel, and upon releasing the compressive force, the spring steel would put the fiber into tension. Alternatively, the fiber may be pretensioned using an external tensioning mechanism, then placed on a fixed frame in the tensioned state.

After appropriate tensioning, the tensioned fiber is placed into a mold that is precisely machined to allow the fibers to be totally encased within the outer coating. Specifically, any fiber within the coating will be centered horizontally and near the lower surface in the vertical plane, such that there is a greater amount of polyurethane coating above the fiber than below the fiber. The coating will effectively separate openings in the screen panel. After the wear-resistant polyurethane or rubber coating is molded around the frame and concurrently around the fiber, a finished panel will result.

The invention includes a rectangular polyurethane or rubber screen panel with fiber reinforcement, where the fiber is held in tension by a frame mechanism that is internal to the screen panel. Openings in the screen panel are formed by polyurethane or rubber bars, with each bar that is oriented in a longitudinal direction having an internal fiber reinforcement, while each bar that is transverse to the longitudinal bars has no fiber reinforcement. The panel is held in a modular screen support frame by mechanical means such that the fiber reinforcement is held in tension, while the panel itself is not.

The use of high tensile strength fiber considerably facilitates smaller bars between openings than is possible with non-reinforced modular screen panels. This configuration allows more openings in the screen panel, and it also allows a thinner screen surface that eliminates the tunnels that are common in fine screens. Furthermore, the small width of the bars between openings allows for a very resilient screen surface that promotes better stratification of the material on the bed. The end result is a more efficient screen medium that can be used in a much broader range of applications than previous technology allowed.

Accordingly, it is an object of the present invention to provide an improved modular screen design for a material separator device.

It is a further object of the invention to provide a screen panel design utilizing polymer body reinforced by tensioned reinforcing members, but wherein the body itself is not placed in tension.

It is a further object of the invention to provide a modular screen panel yielding more efficient screening of various sized materials.

It is a further object of the invention to provide a modular screen panel for use in flat bed screening machines that is more resilient at higher loads than previous screen panels that are not reinforced.

In addition to the foregoing, further, objects, features, and advantages of the present invention should become more readily apparent to those skilled in the art upon a reading of the following detailed description in conjunction with the drawings, wherein there are shown and described illustrated embodiments of the invention.

DESCRIPTION OF THE PREFERRED EMBODIMENTS

Figure 1:
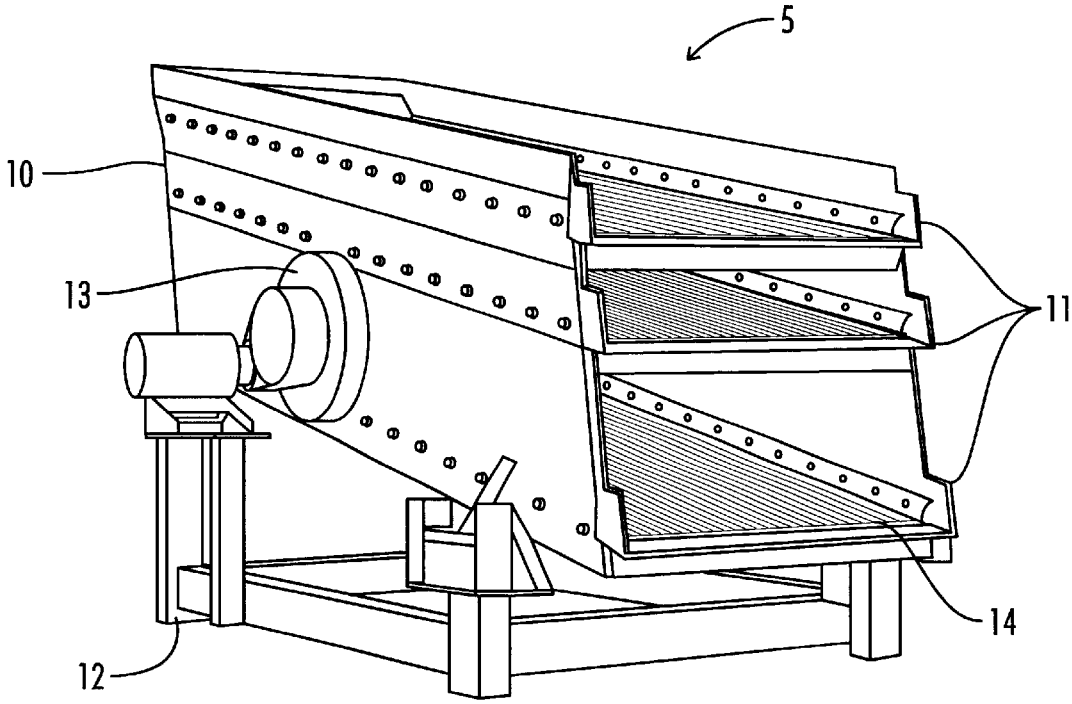
FIG. 1 (Prior Art)
FIG. 1 is a perspective view of a prior art screening machine.

Referring to FIG. 1, an exemplary screening machine 5 is shown, with a rectangular screening container 10 being pitched at an acute angle and having three screening decks 11. Container 10 is mounted on a base 12 such that container 10 is able to vibrate up and down, in a circular motion, or elliptically. A weighted drive shaft 13 is inserted through and attached to container 10, imparting a vibration to container 10. As container 10 vibrates, material placed into the upper end of container 10 either filters down through an opening in one or more screening decks 11 or passes through the open end 14 of container 10. Screening machine 5 is one of many different types of screening machines that could be used; configuration of a screening machine depends on numerous factors such as type and physical characteristics of the material being screened.

Figure 2:
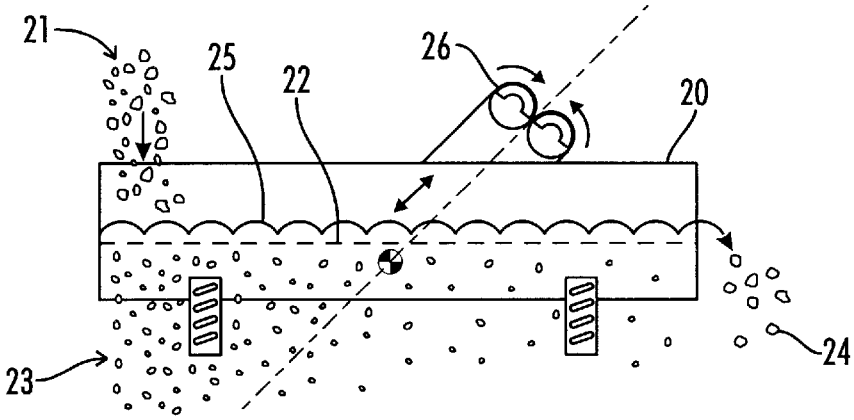
FIG. 2 (Prior Art)
FIG. 2 is a side elevation diagram of a prior art screening machine.

Referring to FIG. 2, a second type of screening machine 20 is shown, with unscreened material 21 (or "feed") being placed into screening machine 20, then through the vibration of screening machine 20, feed 21 passes substantially horizontally along a screen deck surface 22, with a portion of feed 21 passing through screen deck 22 as screened material 23, and the remainder 24 passing out of the open end of screening machine 20. Feed 21 passes along screening path 25, which is an undulating path caused by the action of a pair of weighted drive shafts 26 which are attached to screening machine 20 so as to cause feed 21 to be thrown at a 45-degree angle to screen deck surface 22 in the direction of the open end of screening machine 20.

Figure 3:
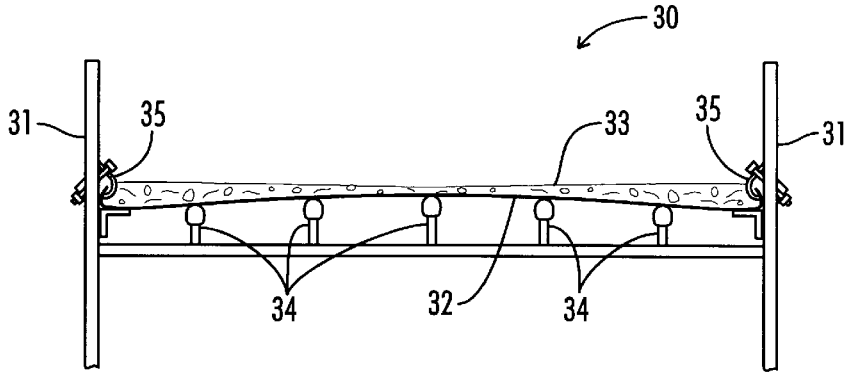
FIG. 3 (Prior Art)
FIG. 3 is a cross-sectional elevation view of a prior art arched-bed screen as attached to a screening machine frame.

Referring to FIG. 3, a prior art arched-bed screen arrangement 30 is shown. A pair of side walls 31 define the outer portions of the screening area, and a screen 32 interacts with feed 33 to allow a portion of appropriately sized feed 33 to pass through screen 32. A slight arch is imparted to screen 32 via a number of lower supporting members 34. The outer edges of screen 32 are secured to the screening machine by a pair of fasteners 35 that cause screen 32 to be drawn down tightly onto supporting members 34, delivering an appropriate amount of tension to screen 32 to prevent screen 32 from inefficient motion that would eventually damage the screen and possibly other portions of the machine due to the flagellation of a loose screen.

Figure 4:
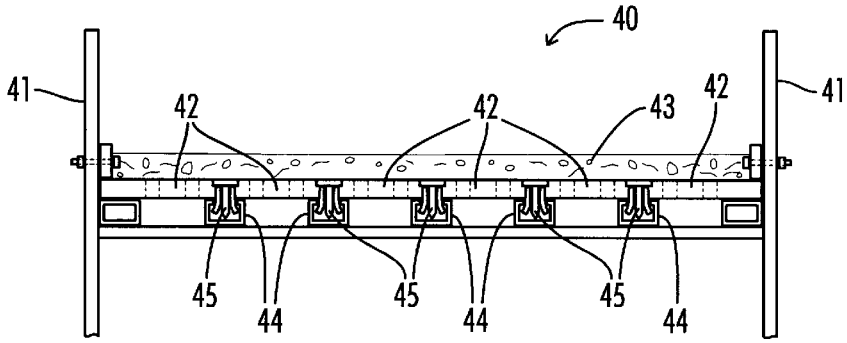
FIG. 4 (Prior Art)
FIG. 4 is a cross-sectional elevation view of a prior art flat-bed screen as attached to a screening machine frame.

Referring to FIG. 4, a known flat-bed screen arrangement 40 is shown. A pair of side walls 41 define the outer portions of the screening area, and a screen structure made from a number of screen panels 42 interacts with feed 43 to allow a portion of appropriately-sized feed 43 to pass through screen panels 42. Supporting members 44 support the lower surface of screen panels 42. The outer edges of screen panels 42 are mechanically fastened to supporting members 44 by a conventional fastening method such as pin-type fasteners 45, so that screen panels 42 are rigidly held in place across the surface of arrangement 40.

Figure 5:
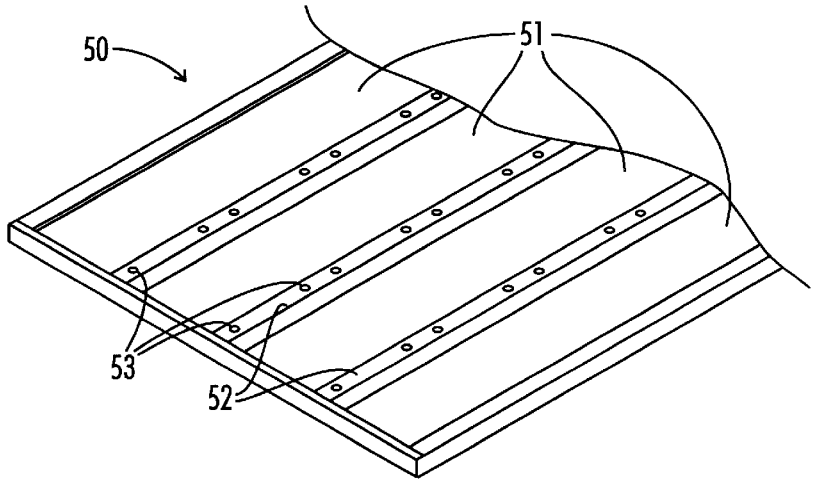
FIG. 5 (Prior Art)
FIG. 5 is a perspective view of a support framework for supporting either prior art screen panels or the modular screen panel of the present invention.

Referring to FIG. 5, a modular panel frame 50 is used to divide a screen surface into a number of smaller panel areas 51, each having a width dimension of approximately one (1) foot. Frame 50 has been devised with a number of panel supports 52 providing the necessary support for a number of screen panels, as will be seen below. Each panel support 52 has numerous apertures 53 defined therein, so that each panel may be securely fastened to modular panel frame 50.

Figure 6:
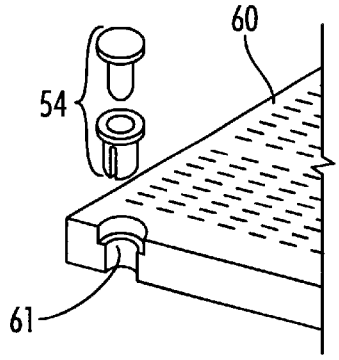
FIG. 6 (Prior Art)
FIG. 6 is a perspective exploded view of the components for fastening the screen panel of the invention to the framework of FIG. 5 using a pin-type fastening system.
Figure 7:
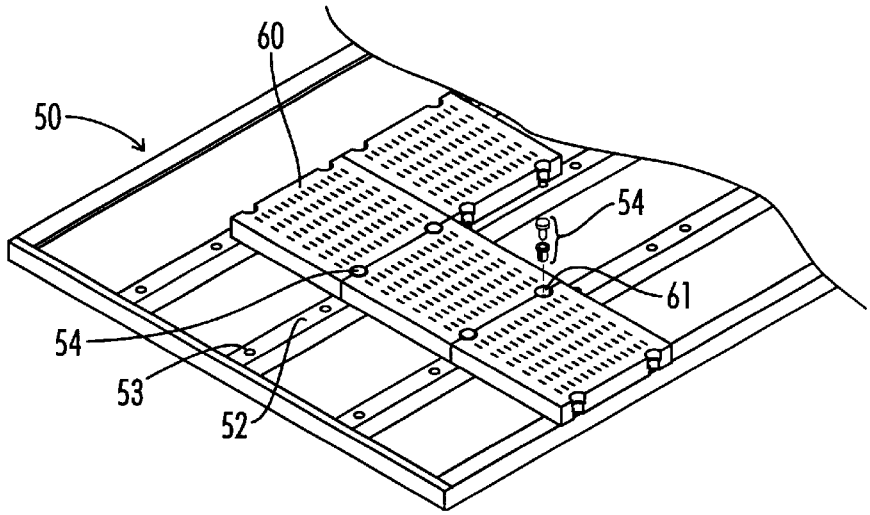
FIG. 7 (Prior Art)
FIG. 7 is a perspective view of the screen panel of FIG. 6 fastened to the framework of FIG. 5 using a pin-type fastening system.

Referring to FIG. 6, a panel 60 is shown, with one method of fastening panel 60 of the invention to modular panel frame 50 being the forming of semicircular cavities 61 in the perimeter of panel 60 to correspond with apertures 53. A conventional pin-type assembly 54 provides for the securing of panel 60 to modular panel grid 51. Referring to FIG. 7, a panel 60 is shown after attaching panel 60 to modular panel grid 51 using conventional pin-type assembly 54.

Figure 8:
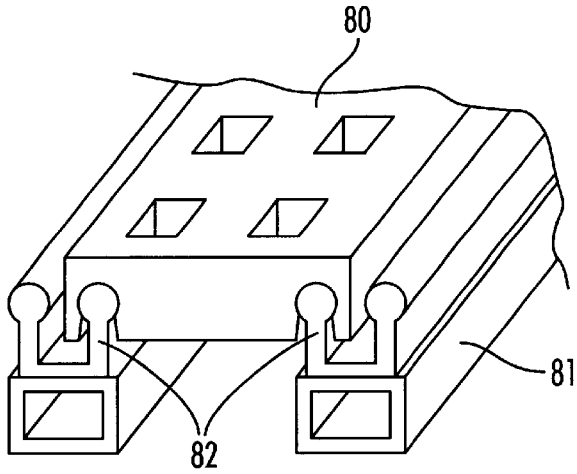
FIG. 8 (Prior Art)
FIG. 8 is a perspective view showing an alternative configuration of the fastening of the screen panel of the invention to a supporting framework.

Referring to FIG. 8, another possible method of fastening a screen panel 80 to a modular panel grid 81 employs a conventional set of rails 82 protruding upward from grid 81, with which a screen panel 80 having complementary grooves defined therein is forcibly mated using a mallet or similar implement. Both the pin-type fastening method shown in FIGS. 5–7 and the rail/groove method shown in FIG. 8 are well known to those skilled in the art.

Figure 9:
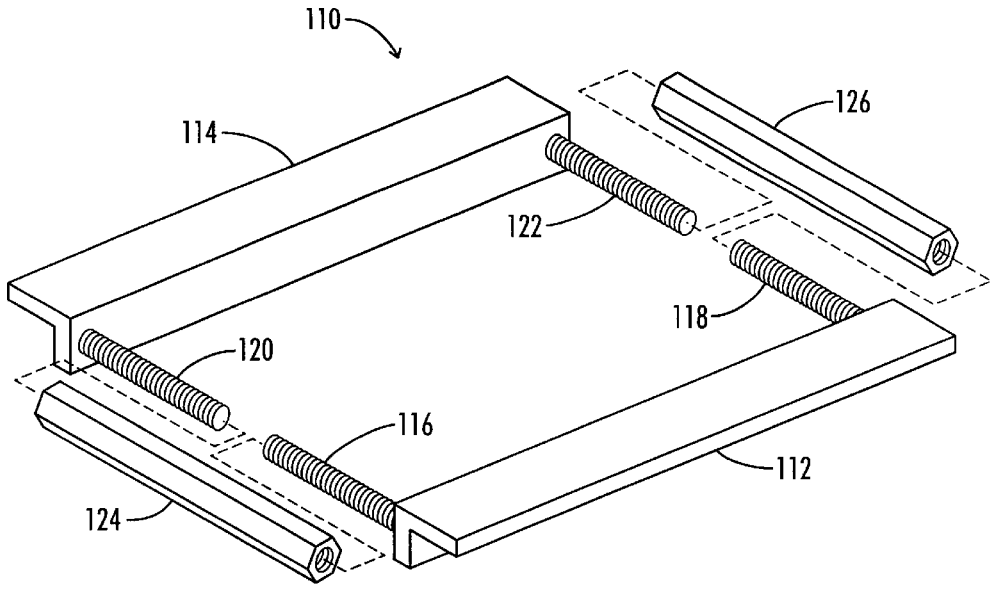
FIG. 9 is an exploded perspective view of a framework for the screen panel of the invention.
Figure 10:
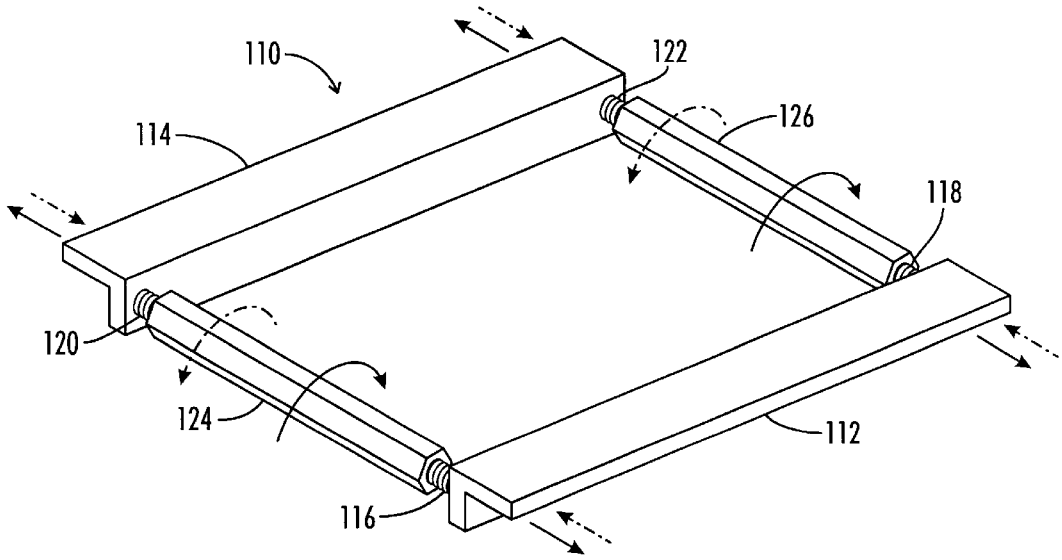
FIG. 10 is a perspective view of the framework of FIG. 9.

Referring to FIG. 9, a preferred method of making the frame 110 of the screen panel of the invention is shown in exploded perspective view. Frame 110 includes opposed load-bearing members 112 and 114. Attached to load-bearing member 112 are first and second threaded rods 116 and 118. Attached to load-bearing member 114 are first and second threaded rods 120 and 122. A first threaded nut or turnbuckle 124 connects the threaded rods 116 and 120. A second threaded nut 126 connects the threaded rods 118 and 122. The threads on rods 116 and 120 are directed in opposite directions from each other, that is, one is a left-hand thread and the other is a right-hand thread, so that when elongated nut 124 is rotated, members 112 and 114 can be moved either closer together or further away to impart appropriate tension as will be seen. Rods 118 and 122 and nut 126 are similarly constructed. Referring to FIG. 10, frame 110 is shown in perspective view, after assembly of frame 110 such that the rotation of nuts 124 and 126 vary the separation of members 112 and 114.

Figure 11:
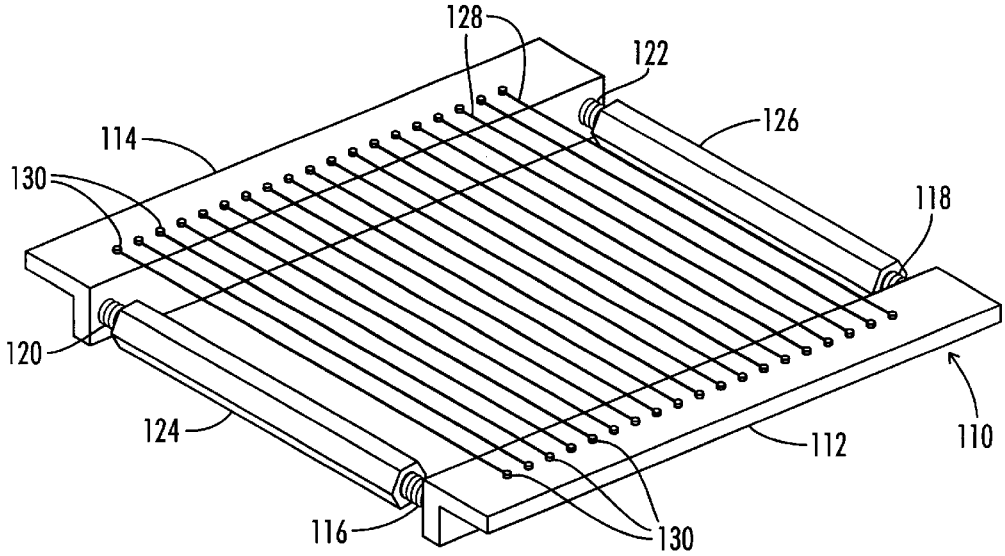
FIG. 11 is a perspective view of the framework of FIG. 10 with a fiber reinforcement placed thereon.

Referring to FIG. 11, one or more fiber reinforcements 128 are placed across a frame made from members 112 and 114 and are secured thereto. In a preferred embodiment, securing is accomplished by fixing opposite ends of a fiber reinforcement 128 to each of members 112 and 114. Fixing the ends of any of fiber reinforcements 128 may be performed by attaching the ends of each fiber reinforcement 128 to pins or supports 130 on members 112 and 114. The attaching of fiber reinforcements 128 to pins or supports 130 may be done in any of a number of ways, such as wrapping, gluing, or epoxying the ends of fiber reinforcements 128 to pins or supports 130. Alternatively, a single fiber reinforcement may be woven back and forth between pins or other suitable supports 130 located on members 112 and 114. In place of pins or supports 130, any manner of securing the fiber reinforcement to the supporting frame will suffice. In an alternative embodiment, fiber reinforcements 128 may be tensioned before fixing them to members 112 and 114. Pretensioning fiber reinforcements 128 before fixing them to members 112 and 114 would obviate the need for a frame that is adjustable in width, such that a frame having rigidly connected members and a fixed screening area would suffice.

After attaching fiber reinforcements 128 to frame 110, nuts 126 and 128 may be rotated to move members 112 and 114 away from each other, adding further tension to fiber reinforcements 128. An acceptable range for the tension load of fiber reinforcements 128 is 50–160 pounds per inch of width (PIW). Fiber reinforcements 128 may be any of a number of suitable high-strength fibers. One such family of fibers is aromatic polyamide (aramid) fibers, such as those sold under the trademark Kevlar®. Another type of fibers is made of polyphenylenebenzobisozazole (PBO). Another group of fibers is made from liquid crystal polymer, such as those sold by the Celanese Company under the trademark Vectran®. Any type of fiber would be acceptable if such fiber meets two basic material characteristics: high tensile strength and low creep characteristics. In this context, tensile strength is a measure of the linear load that may be applied to a fiber of a certain cross-sectional area without causing the fiber to break down. Similarly, "creep characteristic" refers to the ability of a segment of a fiber to resist linear deformation under a long-term load. An ideal fiber would not break down or stretch under an infinite load. In the instant case, a tensile strength of at least 2000 Megapascals (Mpa) and a creep characteristic of less than 1% of the segment's length are preferred (one pound per square inch is equal to 6.894757 E+3 pascals). Moreover, fiber reinforcements 128 may be of a single-strand or a multiple-strand construction.

Figure 12:
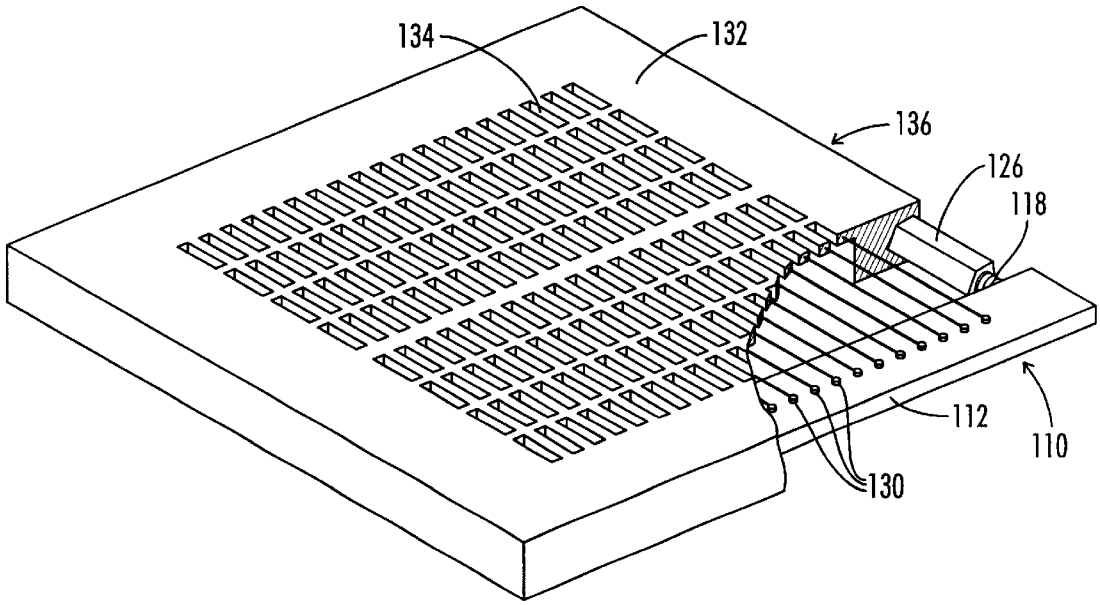
FIG. 12 is a perspective view of the screen panel of the invention, with a corner cut away to show the supporting framework and internal fiber reinforcement.

Referring to FIG. 12, screen panel 136 is shown in perspective view with a portion of resilient coating cut away to reveal the frame and internal tensioning elements described above relating to FIGS. 9–11. Resilient coating 132 may be of polyurethane, rubber, or any similar type of polymer coating as is well-known in the art, and resilient coating 132 should be molded around frame 110 and fiber reinforcements 128. In a preferred embodiment, the mold should allow for a number of elongated slot-shaped openings 134 to be defined in screen panel 136 for screening material therethrough. Screen panel 136 typically has dimensions in plan view in a range from one to four square feet. These urethane encapsulated modular screen panels are characterized by the fact that the reinforcing fibers 128 are in tension, whereas the urethane body 132 is not in tension. These modular panels may be utilized with a flat bed screen assembly to provide screening operations in a conventional manner. In practice, a number of screen panels 136 are mechanically fastened in a known manner such as that described above relating to FIGS. 5–8. A number of apertures are defined in screen panel 136 for screening material. Apertures may be of any shape, such as round, square, or slotted. Larger apertures can be up to ½ inch, and smaller apertures (typically a slotted shape) may be 0.1 mm wide and 4 mm long. The screening machine is operated in the normal manner, and it will be seen that the screen panel of the invention exhibits the efficiency and wear life improvements discussed above.

Thus, although there have been described particular embodiments of the present invention of a new and useful Screen Apparatus and Method, it is not intended that such references be construed as limitations upon the scope of this invention except as set forth in the following claims.

I claim:

1. A panel for screening material, comprising:

a frame, the frame comprising a plurality of sides defining a screening area;

at least one tensioned fiber reinforcement attached to the frame and spanning across the screening area; and a non-tensioned resilient coating surrounding the at least one fiber reinforcement so as to form a plurality of openings of a size to screen at least a portion of the material through the screening area;

wherein the at least one fiber reinforcement is of a material selected from the group consisting of an aromatic polyamide substance, a polyphenylenebenzobisozazole material, and a liquid crystal polymer material.

2. The panel of claim 1, wherein the at least one fiber reinforcement is of an aromatic polyamide substance.

3. The panel of claim 1, wherein the at least one fiber reinforcement is of polyphenylenebenzobisozazole material.

4. The panel of claim 1, wherein the at least one fiber reinforcement is of liquid crystal polymer material.

5. The panel of claim 1, wherein the at least one fiber reinforcement has a tensile strength of at least 2000 Megapascals.

6. The panel of claim 1, wherein the at least one fiber reinforcement has a creep characteristic of less than 1%.

7. The panel of claim 1, wherein the resilient coating is rubber.

8. The panel of claim 1, wherein the resilient coating is polyurethane.

9. The panel of claim 1, wherein the frame further comprises a pair of frame members, the pair of frame members each having a first end and a second end, the pair of frame members adjustably connected to each other at said first ends and said second ends.

10. The panel of claim 1, wherein the at least one fiber reinforcement includes a continuous strand of fiber passing back and forth across the screening area a plurality of times.

11. The panel of claim 1, wherein the at least one fiber reinforcement includes multiple separate fiber segments each segment spanning the screening area.

12. The panel of claim 1, wherein the at least one fiber reinforcement is of a plurality of fibers mutually involved with each other.

13. A method of making a screen for screening material on a frame, comprising the steps of:

placing a fiber reinforcement on the frame to form a screening area;

tensioning the fiber reinforcement;

coating both the tensioned fiber reinforcement and the frame with a resilient coating; and maintaining the fiber reinforcement permanently under tension.

14. The method of claim 13, wherein the tensioned fiber reinforcement is repeatedly placed across the frame to form a plurality of screen openings across the screening area.

15. The method of claim 13, wherein the tensioned fiber reinforcement is of an aromatic polyamide material.

16. The method of claim 13, wherein the tensioned fiber reinforcement is of a polyphenylenebenzobisozazole material.

17. The method of claim 13, wherein the tensioned fiber reinforcement is of liquid crystal polymer material.

18. The method of claim 13, wherein the tensioned fiber reinforcement has a tensile strength of at least 2000 Megapascals.

19. The method of claim 13, wherein the tensioned fiber reinforcement has a creep characteristic of less than 1%.

20. The method of claim 13, wherein the resilient coating is abrasion resistant.

21. The method of claim 13, wherein the resilient coating is wear resistant.

22. The method of claim 13, wherein the resilient coating is rubber.

23. The method of claim 13, wherein the resilient coating is polyurethane.

24. The method of claim 13, wherein the frame is width-adjustable.

25. The method of claim 24, wherein the tensioning step is performed by adjusting the width of the frame.

26. The method of claim 13, wherein the tensioning step is performed before the placing step is performed.

27. A vibratory screening machine apparatus, comprising:

a machine frame; and at least one screen panel fastened to the machine frame, the at least one screen panel being substantially planar when fastened to the machine frame, the at least one screen panel further having a screen frame, the screen frame supporting a nontensioned resilient material integrally reinforced with a tensioned fiber, the nontensioned resilient material also covering the screen frame, so that material to be screened is at least partially screened through the at least one screen panel.

28. The apparatus of claim 27, wherein the tensioned fiber is of an aromatic polyamide material.

29. The apparatus of claim 27, wherein the tensioned fiber reinforcement is of a polyphenylenebenzobisozazole material.

30. The apparatus of claim 27, wherein the tensioned fiber reinforcement is of a liquid crystal polymer material.

31. The apparatus of claim 27, wherein the screen frame further comprises at least two frame members connected to each other to form a screening area, the screening area defining the boundaries of the nontensioned resilient material integrally reinforced with a tensioned fiber.

32. The apparatus of claim 27, wherein the nontensioned resilient material is rubber.

33. The apparatus of claim 27, wherein the nontensioned resilient material is polyurethane.

34. A method of screening material using a vibratory screening machine, comprising the steps of:

removably attaching a plurality of replaceable screen panels on the screening bed of the vibratory screening machine, each of the plurality of screen panels being substantially planar when removably attached to the vibratory screening machine, each of the plurality of screen panels further having a screen frame, the screen frame supporting a nontensioned resilient material integrally reinforced with a permanently tensioned fiber, and the screen frame being encapsulated in the nontensioned resilient material; and placing material to be screened into the vibratory screening machine such that the material to be screened is at least partially screened through the plurality of screen panels as the vibratory screening machine is operated.

35. The method of claim 34, further comprising the step of removing one of the plurality of screen panels from the vibratory screening machine and replacing the removed screen panel with a replacement screen panel removably attached to the vibratory screening machine.

36. A panel for screening material, comprising:

a frame, the frame comprising a plurality of sides defining a screening area;

at least one tensioned fiber reinforcement attached to the frame and spanning across the screening area; and a non-tensioned resilient coating surrounding both the at least one fiber reinforcement and the frame so as to form a plurality of openings of a size to screen at least a portion of the material through the screening area.

* * * * *